US007864137B2

(12) United States Patent
Kao et al.

(10) Patent No.: US 7,864,137 B2
(45) Date of Patent: Jan. 4, 2011

(54) BURNING SYSTEM HAVING PRINT INTERFACE FOR LIQUID CRYSTAL DISPLAY

(75) Inventors: Yi-Hsiang Kao, Miao-Li (TW); Zhong-Wu Tian, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 882 days.

(21) Appl. No.: 11/796,776

(22) Filed: Apr. 30, 2007

(65) Prior Publication Data

US 2007/0252808 A1 Nov. 1, 2007

(30) Foreign Application Priority Data

Apr. 28, 2006 (TW) ..... 95115280 A

(51) Int. Cl.
*G09G 5/00* (2006.01)

(52) U.S. Cl. ..... 345/3.1; 345/3.2; 345/3.3; 345/1.1; 345/1.3; 345/1.2

(58) Field of Classification Search ..... 345/1.1–1.3, 345/3.1–3.4, 100, 103, 104, 156, 589, 690; 348/839, 634; 375/257, 295, 130, 210; 712/37
See application file for complete search history.

(56) References Cited

U.S. PATENT DOCUMENTS 5,862,310 A * 1/1999 Crawford et al. ..... 358/1.18
6,069,706 A * 5/2000 Kajita et al. ..... 358/1.15
6,523,127 B1 * 2/2003 Takasu ..... 713/324
6,559,826 B1 * 5/2003 Mendelson et al. ..... 345/102
6,873,307 B2 3/2005 Nitta et al.
7,079,163 B2 * 7/2006 Tseng ..... 345/690
7,184,000 B2 * 2/2007 Itakura ..... 345/3.1
2002/0089518 A1 * 7/2002 Shigeta ..... 345/629
2002/0186329 A1 * 12/2002 Tong et al. ..... 348/839
2004/0047226 A1 * 3/2004 Gans et al. ..... 365/230.03
2004/0080482 A1 * 4/2004 Magendanz et al. ..... 345/100
2004/0212610 A1 * 10/2004 Hamlin ..... 345/211
2004/0233189 A1 * 11/2004 Masuda et al. ..... 345/204
2005/0046637 A1 * 3/2005 Mondal ..... 345/547
2005/0086398 A1 * 4/2005 Chuang ..... 710/16
2005/0128214 A1 * 6/2005 Tseng ..... 345/589
2005/0163116 A1 * 7/2005 Anderson et al. ..... 370/389
2005/0201178 A1 * 9/2005 Ho et al. ..... 365/226

(Continued)

FOREIGN PATENT DOCUMENTS

KR 20030080762 A 10/2003

*Primary Examiner*—Prabodh M Dharia
(74) *Attorney, Agent, or Firm*—Wei Te Chung

(57) ABSTRACT

An exemplary burning system (20) for a liquid crystal display includes a VGA (video graphics array) interface (230), a DVI (digital visual interface) (240), an interface-inverting circuit (220) configured for selectively switching between connectivity with the VGA interface and connectivity with the DVI, and a host computer (250) including a print interface (210). The host computer is configured for burning extended display identification data for the VGA interface into the liquid crystal display via the print interface, the interface-inverting circuit and the VGA interface, and is configured for burning extended display identification data for the DVI into the liquid crystal display via the print interface, the interface-inverting circuit and the DVI.

20 Claims, 2 Drawing Sheets

U.S. PATENT DOCUMENTS

2006/0082584 A1* 4/2006 Noorbakhsh et al. ..... 345/531
2006/0085627 A1* 4/2006 Noorbakhsh et al. ..... 713/1
2006/0139367 A1* 6/2006 Tseng ..... 345/589
2006/0238503 A1* 10/2006 Smith et al. ..... 345/156
2006/0238722 A1* 10/2006 Jayaram et al. ..... 353/85
2007/0165036 A1* 7/2007 Chang et al. ..... 345/519
2008/0303745 A1* 12/2008 Tseng et al. ..... 345/1.1
2008/0307200 A1* 12/2008 Tseng ..... 712/37

* cited by examiner

BURNING SYSTEM HAVING PRINT INTERFACE FOR LIQUID CRYSTAL DISPLAY

FIELD OF THE INVENTION

The present invention relates to a burning system including a print interface for a liquid crystal display.

GENERAL BACKGROUND

Liquid crystal displays (LCDs) are commonly used as displays for compact electronic apparatuses. This is because LCDs not only provide good quality images with little power, but they are also very thin. A liquid crystal display, generally, includes a video graphics array (VGA) interface or a digital visual interface (DVI). A high-grade liquid crystal display may include both the VGA interface and the DVI.

The VGA interface and the DVI can both communicate with a host computer via a display data channel (DDC), which is a communication channel between the host computer and the liquid crystal display. Each mass manufactured liquid crystal display is provided with a set of standard identification data called extended display identification data (EDID). EDID contains information such as manufacturer details, a timing sequence of the liquid crystal display, and maximum image sizes and color performances of the liquid crystal display. This data must be burned into the liquid crystal display before the DDC can be used.

Physical parameters of the VGA interface are generally different from those of the DVI. Likewise, the EDID for the VGA interface is, generally, different from that for the DVI. Due to these differences, typically, the EDID for the VGA interface and the EDID for the DVI are burned into each liquid crystal display at two different workstations of a mass production line. The liquid crystal display must be transported between the two workstations. This process requires suitable transportation equipment, and can be time-consuming. The efficiency of manufacturing the liquid crystal display is limited, and the cost of manufacturing the liquid crystal display is correspondingly high.

What is needed, therefore, is a burning system for a liquid crystal display that can overcome the above-described deficiencies.

SUMMARY

In one preferred embodiment, a burning system for a liquid crystal display includes a VGA (video graphics array) interface, a DVI (digital visual interface), an interface-inverting circuit configured for selectively switching between connectivity with the VGA interface and connectivity with the DVI, and a host computer including a print interface. The host computer is configured for burning extended display identification data for the VGA interface into the liquid crystal display via the print interface, the interface-inverting circuit and the VGA interface, and is configured for burning extended display identification data for the DVI into the liquid crystal display via the print interface, the interface-inverting circuit and the DVI.

Other novel features and advantages will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of at least one embodiment of the present invention. In the drawings, like reference numerals designate corresponding parts throughout various views and all the views are schematic.

DETAILED DESCRIPTION OF PREFERRED EMBODIMENTS

Reference will now be made to the drawings to describe the present invention in detail.

Figure 1:
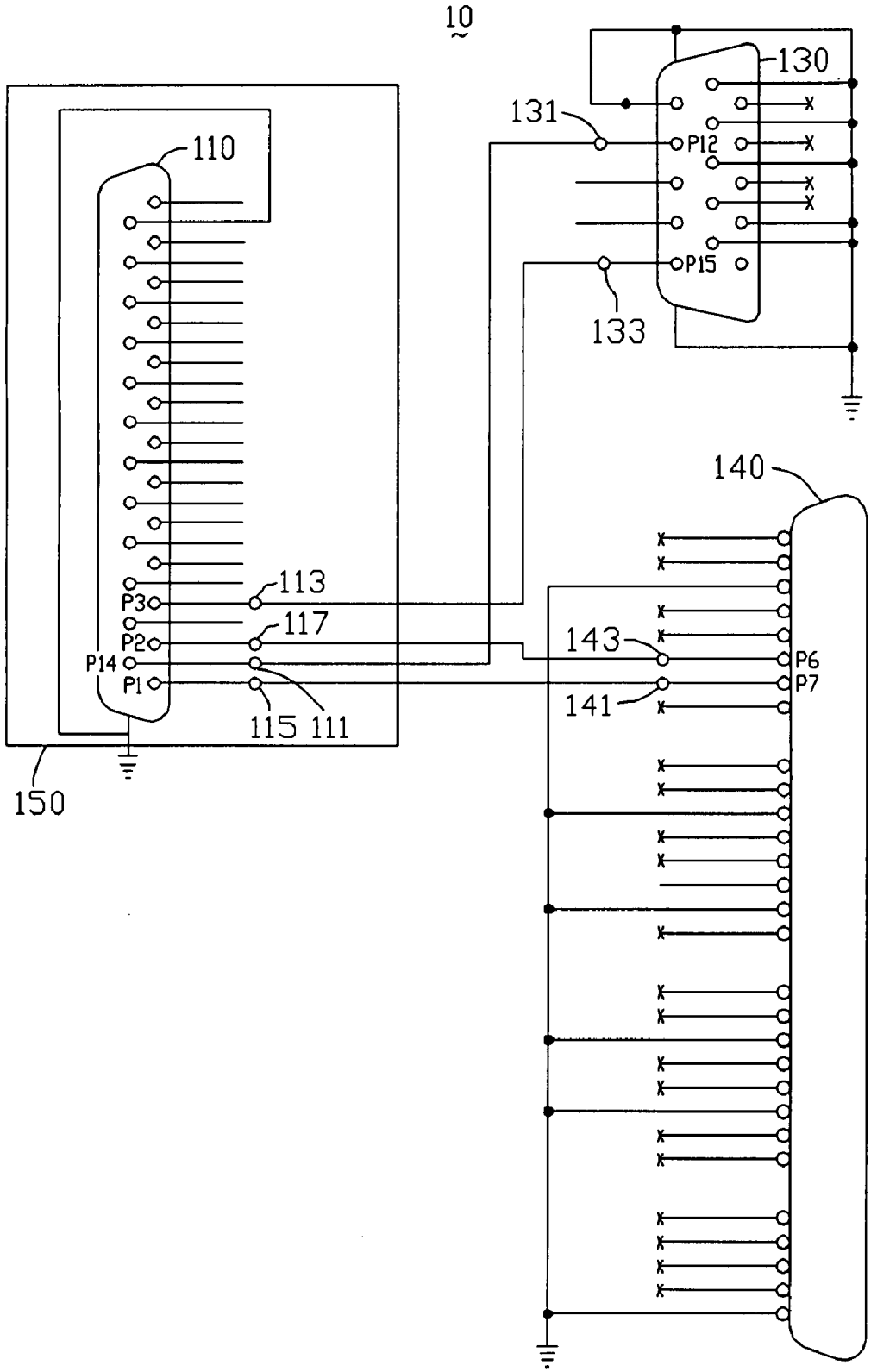
FIG. 1 is a block diagram of a burning system for a liquid crystal display according to a first embodiment of the present invention.

Referring to FIG. 1, a burning system 10 for a liquid crystal display (not shown) according to a first embodiment of the present invention is shown. The burning system 10 includes a host computer 150 having a print interface 110, a connection cable (not shown), a VGA interface 130 and a DVI 140. In a typical arrangement incorporating the burning system 10, the connection cable physically interconnects a first socket (not shown) of the host computer 150 and a second socket (not shown) and a third socket (not shown) of the liquid crystal display. The first socket represents the print interface 110 of the host computer 150, the second socket represents the VGA interface 130 of the liquid crystal display, and the third socket represents the DVI 140 of the liquid crystal display.

A burning program of the host computer 150 can burn EDID for the VGA interface 130 into the liquid crystal display via the print interface 110, the connection cable and the VGA interface 130 under an inter-integrated circuit ($I^2C$) bus protocol. The burning program of the host computer 150 can, also, burn the EDID for the DVI 140 into the liquid crystal display via the print interface 110 and the DVI 140 under the $I^2C$ bus protocol. The $I^2C$ bus protocol, generally, transmits a serial clock pulse via a serial clock line (SCL) and transmits serial data via a serial data line (SDL). In an alternative embodiment, the burning program for burning the EDID for the VGA interface 130 and the burning program for burning the EDID for the DVI 140 can be different programs.

The print interface 110 includes: a pin P14, serving as a first serial data output terminal 111; a pin P1, serving as a second serial data output terminal 115; a pin P3, serving as a first serial clock pulse output terminal 113; and a pin P2, serving as a second serial clock pulse output terminal 117.

The VGA interface 130 includes: a pin P12, serving as a first serial data input terminal 131; and a pin P15, serving as a first serial clock pulse input terminal 133. The DVI 140 includes: a pin P7, serving as a second serial data input terminal 141; and a pin P6, serving as a second serial clock pulse input terminal 143.

The first serial data output terminal 111 of the print interface 110 is connected to the first serial data input terminal 131 of the VGA interface 130. The first serial clock pulse output terminal 113 of the print interface 110 is connected to the first serial clock pulse input terminal 133 of the VGA interface 130. The second serial data output terminal 115 of the print interface 110 is connected to the second serial data input terminal 141 of the DVI 140. The second serial clock pulse output terminal 117 of the print interface 110 is connected to the second serial clock pulse input terminal 143 of the DVI 140.

With the above-described configuration, the host computer 150 burns the EDID for the VGA interface 130 and the EDID for the DVI 140 into the liquid crystal display via the print interface 110, the connection cable, and the respective VGA interface 130 and DVI 140. That is, the EDID for the VGA interface 130 and the EDID for the DVI 140 can be burned into the liquid crystal display at a single workstation of a mass production line. Unlike in a conventional burning process, there is no need for time-consuming transportation of the liquid crystal display between two different workstations. The efficiency of manufacturing the liquid crystal display is improved, and the cost of manufacturing the liquid crystal display is correspondingly reduced.

A method for burning the EDID for the VGA interface 130 and the EDID for the DVI 140 into the liquid crystal display can include: first, burning the EDID for the VGA interface 130 into the liquid crystal display via the print interface 110, the connection cable and the VGA interface 130; and second, burning the EDID for the DVI 140 into the liquid crystal display via the print interface 110, the connection cable and the DVI 140. In an alternative embodiment, the method for burning the EDID for the VGA interface 130 and the EDID for the DVI 140 into the liquid crystal display can include: first, burning the EDID for the DVI 140 into the liquid crystal display via the print interface 110, the connection cable and the DVI 140; and second, burning the EDID for the VGA interface 130 into the liquid crystal display via the print interface 110, the connection cable and the VGA interface 130.

Figure 2:
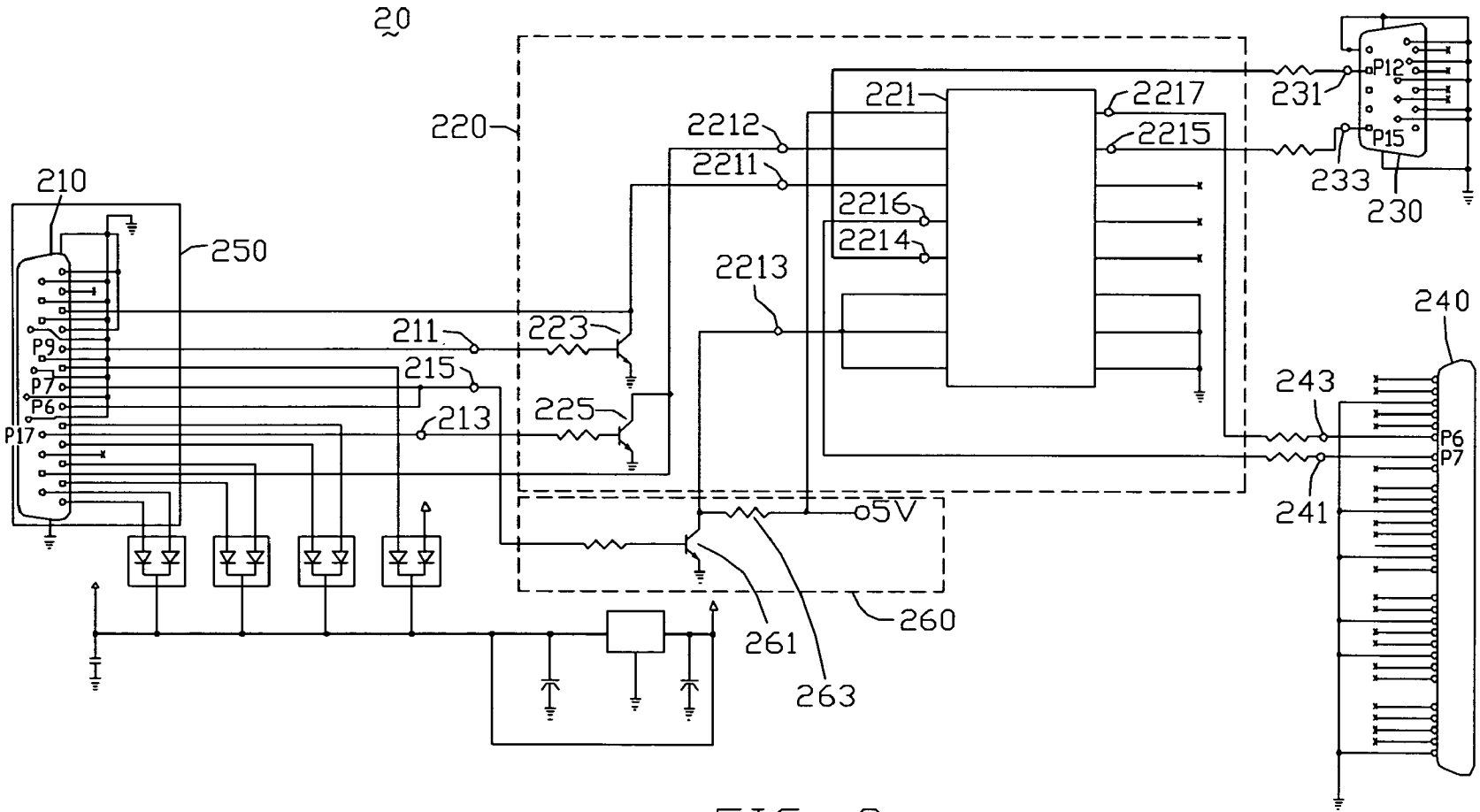
FIG. 2 is a block diagram of a burning system for a liquid crystal display according to a second embodiment of the present invention.

Referring to FIG. 2, a burning system 20 for a liquid crystal display (not shown) according to a second embodiment of the present invention is shown. Except as may be indicated to the contrary below, a typical arrangement incorporating the burning system 20 is similar to the above-described typical arrangement incorporating the burning system 10. The burning system 20 includes a host computer 250 having a print interface 210, an interface-inverting circuit 220, a VGA interface 230, a DVI 240 and a control circuit 260.

The print interface 210 includes: a pin P9, serving as a serial data output terminal 211; a pin P17, serving as a serial clock pulse output terminal 213; and a pin P6 and a pin P7, which cooperatively serve as a control signal output terminal 215.

The VGA interface 230 includes: a pin P12, serving as a first serial data input terminal 231; and a pin P15, serving as a first serial clock pulse input terminal 233. The DVI 240 includes: a pin P7, serving as a second serial data input terminal 241; and a pin P6, serving as a second serial clock pulse input terminal 243.

The interface-inverting circuit 220 includes a switching unit 221, a first transistor 223 and a second transistor 225. In one embodiment, the switching unit 221 can be a 74HC4053 chip. The switching unit 221 includes a first input terminal 2211, a second input terminal 2212, a channel switching input terminal 2213, a first output terminal 2214 connected to the first serial data input terminal 231, a second output terminal 2215 connected to the first serial clock pulse input terminal 233, a third output terminal 2216 connected to the second serial data input terminal 241, and a fourth output terminal 2217 connected to the second serial clock pulse input terminal 243.

The first transistor 223 includes: a base connected to the serial data output terminal 211; an emitter that is grounded; and a collector connected to the first input terminal 2211 of the switching unit 221. The second transistor 225 includes: a base connected to the serial clock pulse output terminal 213; an emitter that is grounded; and a collector connected to the second input terminal 2212 of the switching unit 221.

The control circuit 260 includes a third transistor 261, a resistor 263, and a five-volt power supply. The third transistor 261 includes: a base connected to the control signal output terminal 215; an emitter that is grounded; and a collector connected to the five-volt power supply via the resistor 263. The collector of the third transistor 261 is also connected to the channel switching input terminal 2213 of the switching unit 221.

In operation, the control signal output terminal 215 of the print interface 210 provides a high voltage to the base of the third transistor 261 of the control circuit 260 to switch on the third transistor 261. The channel switching input terminal 2213 of the switching unit 221 is grounded via the collector and the emitter of the third transistor 261. The switching unit 221 is thus switched to the VGA interface 230.

The serial data output terminal 211 of the print interface 210 burns serial data for the VGA interface 230 into the liquid crystal display via the first transistor 223 and the VGA interface 230. The serial clock pulse output terminal 213 of the print interface 210 burns a serial clock pulse for the VGA interface 230 into the liquid crystal display via the second transistor 225 and the VGA interface 230.

The control signal output terminal 215 of the print interface 210 provides a low voltage to the base of the third transistor 261 of the control circuit 260 to switch off the third transistor 261. A five-volt voltage is applied to the channel switching input terminal 2213 of the switching unit 221. Thus, the switching unit 221 is switched to the DVI 240.

The serial data output terminal 211 of the print interface 210 burns serial data for the DVI 240 into the liquid crystal display via the first transistor 223 and the DVI 240. The serial clock pulse output terminal 213 of the print interface 210 burns a serial clock pulse for the DVI 240 into the liquid crystal display via the second transistor 225 and the DVI 240. The burning system 20 can achieve advantages similar to those described above in relation to the burning system 10.

A method for burning the EDID for the VGA interface 230 and burning the EDID for the DVI 240 into the liquid crystal display can include the following steps. First, the interface-inverting circuit 220 is switched to the VGA interface 230. Second, the EDID for the VGA interface 230 is burned into the liquid crystal display via the print interface 210, the interface-inverting circuit 220 and the VGA interface 230. Third, the interface-inverting circuit 220 is switched to the DVI 240. Fourth, the EDID for the DVI 240 is burned into the liquid crystal display via the print interface 210, the interface-inverting circuit 220 and the DVI 240. In an alternative embodiment, the method for burning the EDID for the VGA interface 230 and the EDID for the DVI 240 into the liquid crystal display can include the following steps. First, the interface-inverting circuit 220 is switched to the DVI 240. Second, the EDID for the DVI 240 is burned into the liquid crystal display via the print interface 210, the interface-inverting circuit 220 and the DVI 240. Third, the interface-inverting circuit 220 is switched to the VGA interface 230. Fourth, the EDID for the VGA interface 230 is burned into the liquid crystal display via the print interface 210, the interface-inverting circuit 220 and the VGA interface 230.

It is believed that the present embodiments and their advantages will be understood from the foregoing description, and it will be apparent that various changes may be made thereto without departing from the spirit or scope of the invention or sacrificing all of its material advantages, the examples hereinbefore described merely being exemplary embodiments of the invention.

What is claimed is:

1. A burning system for a liquid crystal display, the burning system comprising:

a VGA (video graphics array) interface;

a DVI (digital visual interface);

an interface-inverting circuit configured for selectively switching between connectivity with the VGA interface and connectivity with the DVI; and a host computer comprising a print interface, the host computer configured for burning extended display identification data for the VGA interface into the liquid crystal display via the print interface, the interface-inverting circuit and the VGA interface, and configured for burning extended display identification data for the DVI into the liquid crystal display via the print interface, the interface-inverting circuit and the DVI.

2. The burning system as claimed in claim 1, wherein the VGA interface comprises a first serial data input terminal and a first serial clock pulse input terminal, and the DVI comprises a second serial data input terminal and a second serial clock pulse input terminal.

3. The burning system as claimed in claim 2, wherein the print interface comprises a serial data output terminal and a serial clock pulse output terminal.

4. The burning system as claimed in claim 3, wherein the interface-inverting circuit comprises a switching unit, a first transistor, and a second transistor.

5. The burning system as claimed in claim 4, wherein the switching unit comprises a first input terminal, a second input terminal, and a channel switching input terminal.

6. The burning system as claimed in claim 5, wherein the first transistor comprises a base connected to the serial data output terminal of the print interface, an emitter that is grounded, and a collector connected to the first input terminal of the switching unit.

7. The burning system as claimed in claim 6, wherein the second transistor comprises a base connected to the serial clock pulse output terminal of the print interface, an emitter that is grounded, and a collector connected to the second input terminal of the switching unit.

8. The burning system as claimed in claim 7, wherein the switching unit further comprises a first output terminal connected to the first serial data input terminal of the VGA interface, a second output terminal connected to the first serial clock pulse input terminal of the VGA interface, a third output terminal connected to the second serial data input terminal of the DVI, and a fourth output terminal connected to the second serial clock pulse input terminal of the DVI.

9. The burning system as claimed in claim 8, further comprising a control circuit configured to control a voltage applied to the channel switching input terminal of the switching unit, the voltage determining the switching between the connectivity with the VGA interface and the connectivity with the DVI.

10. The burning system as claimed in claim 9, wherein the print interface further comprises a control signal output terminal.

11. The burning system as claimed in claim 10, wherein the control circuit comprises a third transistor, and the third transistor comprises a base connected to the control signal output terminal of the print interface, an emitter that is grounded, and a collector connected to the channel switching input terminal.

12. The burning system as claimed in claim 9, wherein the host computer burns the extended display identification data into the liquid crystal display first for one of the VGA interface and the DVI and then for the other of the VGA interface and the DVI.

13. The burning system as claimed in claim 12, wherein when the print interface provides a high voltage to the control circuit via the control signal output terminal, the control signal controls the interface-inverting circuit switching to the VGA interface, and the host computer burns the extended display identification data into the liquid crystal display via the print interface, the interface-inverting circuit and the VGA interface.

14. The burning system as claimed in claim 13, wherein when the print interface provides a low voltage to the control circuit via the control signal output terminal, the control signal controls the interface-inverting circuit switching to the DVI, and the host computer burns the extended display identification data into the liquid crystal display via the print interface, the interface-inverting circuit and the DVI.

15. The burning system as claimed in claim 11, wherein the control circuit further comprises a resistor, a power supply connected to the collector of the third transistor via the resistor.

16. The burning system as claimed in claim 15, wherein the power supply is a five-volt power supply.

17. The burning system as claimed in claim 4, wherein the switching unit comprises a 74HC4053 chip.

18. A burning system for a liquid crystal display, the burning system comprising:

a VGA (video graphics array) interface comprising:

a first serial data input terminal; and a first serial clock pulse input terminal;

a DVI (digital visual interface) comprising:

a second serial data input terminal; and a second serial clock pulse input terminal; and a host computer comprising a print interface, the print interface comprising:

a first serial data output terminal connected to the first serial data input terminal;

a second serial data output terminal connected to the second serial data input terminal;

a first serial clock pulse output terminal connected to the first serial clock pulse input terminal; and a second serial clock pulse output terminal connected to the second serial clock pulse input terminal;

wherein the host computer is configured to burn extended display identification data for the VGA interface into the liquid crystal display via the print interface and the VGA interface and configured to burn extended display identification data for the DVI into the liquid crystal display via the print interface and the DVI, and the host computer comprises a burning program to burn the extended display identification data into the liquid crystal display first for one of the VGA interface and the DVI and then for the other of the VGA interface and the DVI.

19. The burning system as claimed in claim 18, wherein the host computer is connected to the VGA interface and the DVI of the liquid crystal display via a connection cable.

20. A system comprising:

a display comprising a first interface capable of communicating first data with a first format and a second interface capable of communicating second data with a second format;

a host device configured for communicating first data and second data with the display, the host device comprising a third interface defined by a special format; and an interface-inverting circuit coupled to the first interface, the second interface and the third interface, the interface-inverting circuit configured for selectively switching between connectivity of the third interface with the first interface and connectivity of the third interface with the second interface.

* * * * *